US008851340B2

(12) United States Patent
Kreyenberg

(10) Patent No.: US 8,851,340 B2
(45) Date of Patent: Oct. 7, 2014

(54) CONTAINER FOR BEVERAGE

(75) Inventor: Christoph Kreyenberg, Ouderker A/D Amstel (NL)

(73) Assignee: Heineken Supply Chain B.V., Amsterdam (NL)

( * ) Notice: Subject to any disclaimer, the term of this patent is extended or adjusted under 35 U.S.C. 154(b) by 1377 days.

(21) Appl. No.: 12/293,760

(22) PCT Filed: Mar. 19, 2007

(86) PCT No.: PCT/NL2007/050113

§ 371 (c)(1),
(2), (4) Date: Apr. 8, 2009

(87) PCT Pub. No.: WO2007/108684

PCT Pub. Date: Sep. 27, 2007

(65) Prior Publication Data

US 2010/0230433 A1 Sep. 16, 2010

(30) Foreign Application Priority Data

Mar. 20, 2006 (NL) ..... 1031412

(51) Int. Cl.
*B65D 83/24* (2006.01)
*B67D 1/04* (2006.01)
*B67D 1/08* (2006.01)

(52) U.S. Cl.
CPC ..... *B67D 1/0835* (2013.01); *B67D 1/0418* (2013.01)
USPC ..... 222/399; 222/402.14; 222/153.09; 222/153.12; 137/212; 137/322

(58) Field of Classification Search
USPC ..... 222/399, 402.14, 402.25, 529, 153.1, 222/153.09, 153.12, 402.13, 394; 137/317, 137/320, 322, 212, 614.05
See application file for complete search history.

(56) References Cited

U.S. PATENT DOCUMENTS

| | | | | | |
|---|---|---|---|---|---|
| 179,092 | A | * | 6/1876 | Booth | 137/614.05 |
| 3,353,724 | A | | 11/1967 | Johnston | |
| 3,357,601 | A | * | 12/1967 | Crawford et al. | 222/397 |
| 3,395,838 | A | * | 8/1968 | Beres et al. | 222/402.14 |
| 3,428,224 | A | * | 2/1969 | Douglas et al. | 222/402.13 |
| 3,473,556 | A | * | 10/1969 | Marine et al. | 137/322 |
| 3,596,809 | A | | 8/1971 | Taubenheim et al. | |
| 3,687,161 | A | * | 8/1972 | Grguric et al. | 137/614 |

(Continued)

FOREIGN PATENT DOCUMENTS

| | | |
|---|---|---|
| DE | 103116 C | 5/1899 |
| EP | 0349053 | 1/1990 |

(Continued)

*Primary Examiner* — Kevin P Shaver
*Assistant Examiner* — Robert Nichols, II
(74) *Attorney, Agent, or Firm* — Pearne & Gordon LLP

(57) ABSTRACT

A container having a female dispensing valve and containing a gas-containing beverage, wherein around the dispensing valve a first coupler (10) extends, furthermore including a dispensing line which has a coupling element which has a second coupler (14); the coupling element has a largely hollow stem with an end and an opening, wherein the dispensing line links up with the stem opposite the end, such that in coupled condition of the couplers, the stem extends against or into the valve and has brought the valve into and keeps it in an opened position, such that beverage can flow via the valve and the opening into the dispensing line.

26 Claims, 11 Drawing Sheets

(56) References Cited

U.S. PATENT DOCUMENTS

| | | | | | |
|---|---|---|---|---|---|
| 3,765,573 | A | * | 10/1973 | Landsman | 222/182 |
| 3,868,049 | A | | 2/1975 | Johnston | |
| 4,049,158 | A | | 9/1977 | Lo et al. | |
| 4,195,756 | A | * | 4/1980 | Campbell | 222/182 |
| 4,350,299 | A | * | 9/1982 | Stephenson et al. | 239/337 |
| 4,402,429 | A | * | 9/1983 | Vanden Driessche | 222/153.01 |
| 4,449,647 | A | * | 5/1984 | Reed et al. | 222/153.09 |
| 4,510,969 | A | * | 4/1985 | Rodth | 137/614.05 |
| 4,717,048 | A | * | 1/1988 | Stenger | 222/400.8 |
| 4,995,533 | A | | 2/1991 | Vandoninck | |
| 5,027,986 | A | * | 7/1991 | Heinzel et al. | 222/402.24 |
| 5,040,703 | A | * | 8/1991 | Roark et al. | 222/173 |
| 5,090,595 | A | | 2/1992 | Vandoninck | |
| 5,096,095 | A | * | 3/1992 | Burton | 222/173 |
| 5,110,012 | A | * | 5/1992 | Scholle et al. | 222/83.5 |
| 5,110,014 | A | * | 5/1992 | Doundoulakis | 222/396 |
| 5,129,423 | A | * | 7/1992 | Fournier et al. | 137/614.05 |
| 5,145,096 | A | * | 9/1992 | Stenger | 222/400.8 |
| 5,368,207 | A | | 11/1994 | Cruysberghs | |
| 5,562,235 | A | * | 10/1996 | Cruysberghs | 222/396 |
| 5,823,222 | A | * | 10/1998 | Minshull et al. | 137/15.15 |
| 6,360,923 | B1 | | 3/2002 | Vlooswijk | |
| 6,745,922 | B1 | | 6/2004 | Vlooswijk et al. | |
| 6,978,800 | B2 | * | 12/2005 | deCler et al. | 137/540 |
| 7,077,298 | B2 | | 7/2006 | Vlooswijk et al. | |
| 7,140,514 | B2 | | 11/2006 | Van Der Klaauw et al. | |
| 7,188,751 | B2 | | 3/2007 | Van Der Klaauw et al. | |
| 2004/0011828 | A1 | | 1/2004 | Van Der Klaauw et al. | |
| 2004/0050879 | A1 | | 3/2004 | Vlooswijk et al. | |
| 2004/0069368 | A1 | | 4/2004 | Van Der Klaauw et al. | |
| 2004/0069805 | A1 | | 4/2004 | Van Der Klaauw et al. | |
| 2004/0134939 | A1 | | 7/2004 | Van Der Klaauw et al. | |
| 2011/0017780 | A1 | * | 1/2011 | Coroneos | 222/402.1 |

FOREIGN PATENT DOCUMENTS

| | | | |
|---|---|---|---|
| EP | 1284918 | | 2/2003 |
| FR | 2331485 | A | 6/1977 |
| NL | 1015359 | C | 12/2001 |
| NL | 1008601 | C | 4/2004 |
| WO | WO9517340 | | 6/1995 |
| WO | 0035803 | | 6/2000 |
| WO | WO0192145 | A | 12/2001 |
| WO | WO0242197 | A1 | 5/2002 |
| WO | WO02079075 | A2 | 10/2002 |

* cited by examiner

CONTAINER FOR BEVERAGE

The invention relates to a container for beverage, in particular for carbonated beverage.

U.S. Pat. No. 6,360,923 B1 describes a container for beverage, provided with a compartment in which a beverage to be dispensed, such as beer or other carbonated beverage, is included, as well as a pressure gas holder with a pressure control valve for automatically keeping the beverage in the container at a desired set pressure. The container is provided with a dispensing valve, for instance in an upper side, through which beverage can be dispensed.

WO 02/42197 A1 describes a comparable container, where, as a dispensing valve, a valve is used as is known from aerosol technique. Such valves are generally used in aerosol cans for misting liquids or dispensing gases. In this application, an operating mechanism is described for operating the valve, which operating mechanism is arranged for repeatedly opening the valve against the spring pressure of the valve, each time when a portion of the beverage is dispensed.

NL 1015359 describes a dispensing device for beverage, in particular carbonated beverage such as beer, comprising a tapping column and a cooling space, where in the cooling space a container can be set up in which the beverage is included. From the cooling space, a dispensing hose with a valve on a leading end can be passed through the tapping column, such that said valve can be placed in an operating mechanism in the tapping column, so that the valve can be opened and closed with it. The end of the hose remaining behind in the cooling space is provided with a connecting element with a bend, which, using a tapping head, can be pressed down against a valve assembly of the container, so that a gas valve and a beer valve of the valve assembly are opened. A carbon dioxide ($CO_2$) cylinder is provided, which is connected with the tapping head via a second line. Upon pressing down the tapping head, an open communication is formed by the connecting element between the second line and the inside of the container, via the gas valve, for pressurizing the beverage in the container, so that the beverage can be dispensed via the dispensing hose. Pressure control means are provided in or at the tapping head and/or the $CO_2$ cylinder for setting a control pressure for the $CO_2$.

The invention contemplates the provision of a container which can be used, for instance, in a device such as for instance described in NL 1015359, which container can be connected simply and fast for use and with which at all times a desired dispensing pressure is obtained during use. In a container according to the invention, this is achieved by the features according to claim 1 or 2.

In a container according to the invention, use is made of a coupling element which is particularly simple in structure and use. By pressing this coupling element onto or into the valve, the valve is opened and kept open in that the coupling means of the container and the coupling element are in mutual engagement. As a result, beverage can flow directly from the inner space of the container into the dispensing hose. By means of the pressure control unit, the pressure in the inner space is always held at the desired value, for instance set at the equilibrium pressure of the gas in the beverage. The valve can thus be designed simply as an aerosol valve, which means that a robust and relatively cheap valve is used. Surprisingly, it has been found that such a container affords a particularly good dispensing pattern, also for foaming beverages such as beer. The use of a valve, in particular an aerosol valve, then affords the advantage of such valves being cheap to obtain, requiring only a relatively small opening for building-in, so that the pressure thereon is small and mounting them requires relatively little force and moreover contamination of the beverage is simply prevented.

In a particularly advantageous embodiment, the pressure control unit is included entirely within the inner space of the container, so that the desired control pressure can be pre-set and cannot be adjusted by a consumer. The automatically controlled pressure then affords enhanced safety compared with containers where the pressure needs to be set from outside. Such pressure control units are known per se, for instance from NL 1008601C, FR 2 331 485 A, EP 0 349 053, WO 95/17340 and U.S. Pat. No. 5,368,207, which control devices are all suitable for use within the invention. In each of these known devices, however, a valve in the upper side of the respective holder needs to be operated directly for repeated opening and closing of the dispensing opening. An important advantage of such a container is that only beverage needs to be passed out of the container and no gas or the like into the container. As a result, contamination of the beverage is simply prevented.

In a particularly advantageous further embodiment, a pressure control unit is used with an internal volume in which at least so much pressure gas, in particular $CO_2$, is included that the ratio between the volume of pressure gas (measured at 1 atmosphere) and the volume of beverage to be dispensed is smaller than at least 1:25. Preferably, the ratio is smaller than 1:18, more particularly between 1:18 and 1:10. This affords the advantage that during the whole period that beverage is to be dispensed, a same tapping behavior is preserved, also when the keg has been tapped to the extent of being virtually empty. Then, preferably, use is made of a means in said internal volume that at least partly adsorbs and/or absorbs the pressure gas, such as activated carbon, zeolite or other like means known per se. The pressure in the pressure control unit, in particular of the pressure gas, is then, with the unit wholly filled, preferably lower than 12 bars, more particularly lower than 8 bars at room temperature, so that a safe device is obtained which moreover affords an advantageous ratio in volume of the pressure control unit and the volume of the device as a whole.

The valve is preferably secured in the container using a connection involving a click edge which has been obtained on the outside of the container. To that end, for instance a folded connection can be used with an inwardly or outwardly projecting folded edge which can be used as such a click edge, as first coupling means. Between the click edge and the second coupling means, during use, preferably a fixed connection is formed which moreover is liquid- and gas-tight. As a result, a simple connection has been obtained which is moreover cheap in production and use.

The cooperating first and second coupling means are preferably of self-locating design. To that end, in the use of a female valve, use can for instance be made of a locating edge in leading position with respect to the stem of the second coupling means, which tapers slightly in order to center the stem and hence also the coupling means with respect to the valve. In the use of a male valve, for instance an apron may be provided with a slightly conical shape, extending from the second coupling means around a connecting opening of the hose, which apron can reach, as a locating edge, over the valve for the purpose of centering the coupling means and the stem. It is then preferred that the locating edge comes into contact with the valve before the second coupling means is eventually secured on the first coupling means. In this way, the freedom of some relative movement is preserved.

The coupling element preferably comprises at least two openings which during use form a communication between the valve and the hose. The openings then preferably have a slightly elongate shape, so that a relatively large flow-through surface is obtained, the positioning of the openings relative to the valve is less critical and moreover the chance of blockades of the openings is reduced.

With a container according to the invention, at the end of the hose remote from the second coupling means, a shutoff is provided. This provides the advantage that upon coupling of the first and second coupling means the valve is opened and yet beverage can be prevented from flowing out of the hose, also when using an internal pressure control unit that automatically adjusts the pressure to the desired dispensing pressure. Preferably, said shutoff is supplied in a closed position and it is opened by a user only after broaching the container. To that end, the shutoff can for instance be produced in the closed position, or be placed in that position after production, or be provided with spring means biasing the shutoff in the closed position. In an alternative embodiment, of course, the hose may be closed off, for instance squeezed shut using external means such as a shutoff of the hose cock-type.

Preferably, the hose and the coupling element, and the shutoff if present, are jointly disposable. This is to be understood to mean in any case that they can be jointly taken from the container and removed for destruction, but of course they may also be designed so as to be separable from each other for recycling.

The invention furthermore relates to a dispensing hose and a method, in particular as respectively characterized by the features according to claim 15 and claim 16.

In the further subclaims, further advantageous embodiments of a container and device according to the invention are set forth.

To clarify the invention, embodiments of a device and method according to the invention will be further elucidated with reference to the drawing. In the drawing.

Figure 3A:
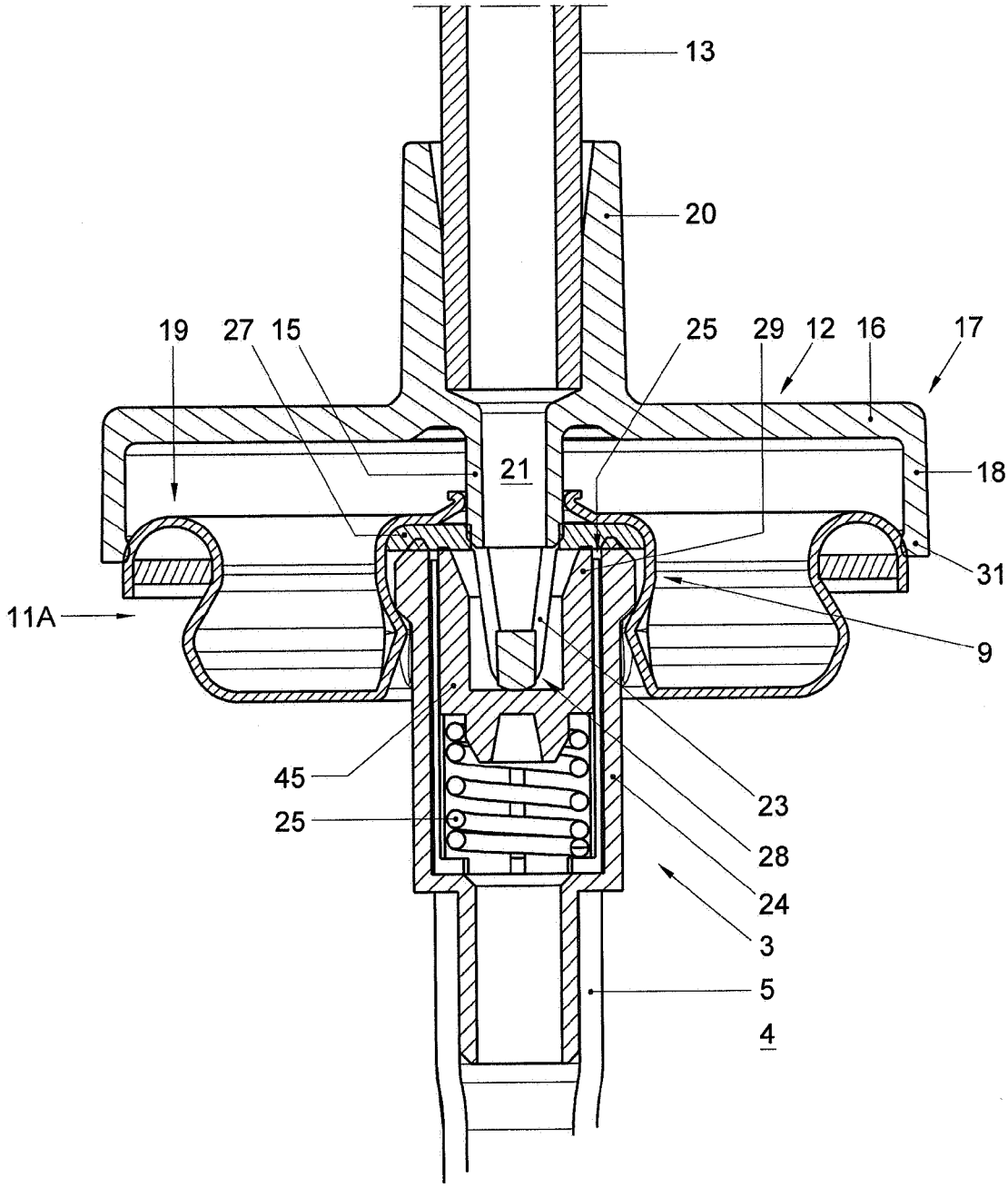
Figure 4:
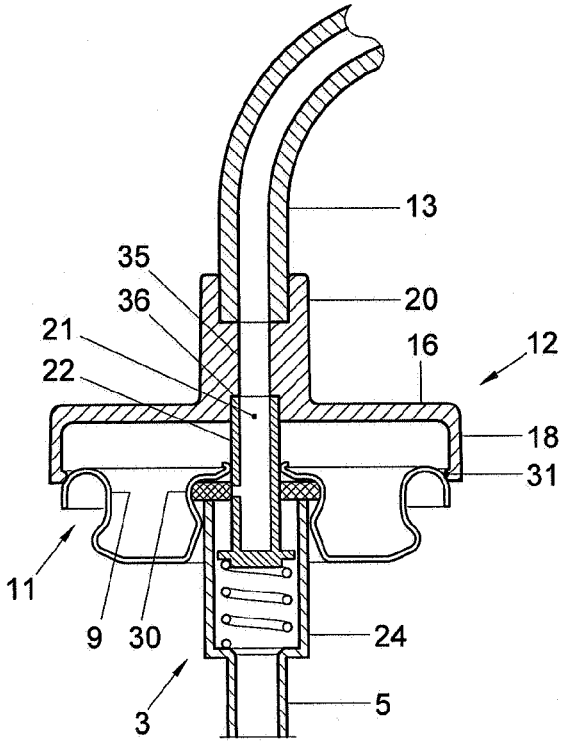
Figure 5:
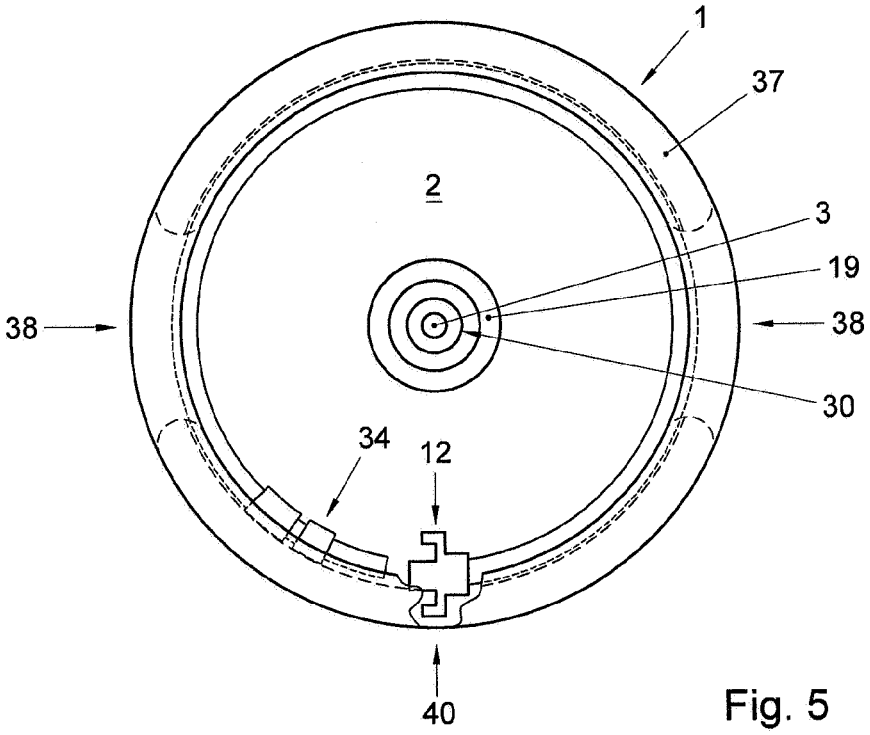

FIGS. 3A and B show an embodiment of a valve assembly with a coupling element in uncoupled and coupled condition, respectively;

FIGS. 3 C-H show different embodiments of the connection between the container, in particular the dispensing valve thereof, and a coupling element;

FIG. 4 shows an alternative embodiment of a dispensing valve and a coupling element; and FIG. 5 shows in top plan view a container according to the invention with dispensing hose.

In this description, the same or corresponding parts have the same or corresponding reference numerals. All possible combinations of parts of the embodiments shown fall within the invention. In the description, containers for beer are shown and described, but it will be clear that also other fluids, in particular carbonated beverages, can be used in a container according to the invention.

Figure 1:
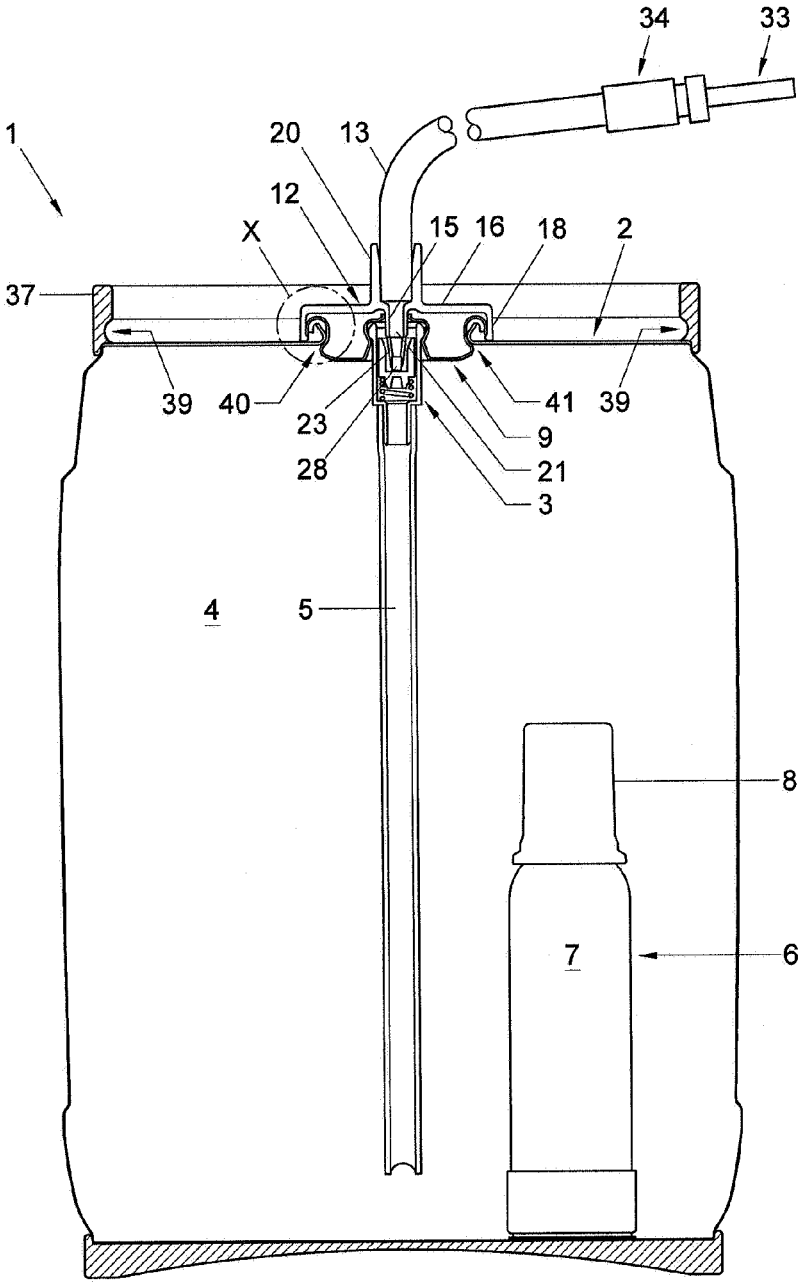
FIG. 1 shows a container according to the invention, partly in cross section, in a first embodiment.
Figure 1A:
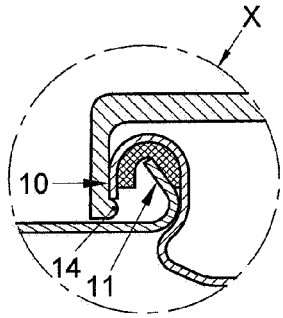
FIG. 1A shows, magnified, the portion X in FIG. 1.

In FIG. 1, a container 1 according to the invention is shown, designed as a relatively stiff, form-retaining container, for instance manufactured from plastic or, preferably, metal such as steel or aluminum. In an upper face 2 of the container 1, a dispensing valve 3 is arranged, through which beverage such as beer can be dispensed from the container, in a manner to be further described hereinafter. In the preferred embodiments shown, the dispensing valve 3 is designed as a spray can valve or aerosol valve as known from spray cans, which are simple in structure, robust and can be easily built in. Such a valve is available as a male variant (FIG. 4), female variant (FIGS. 3 A-H) and as a tilting valve. Preferred within the invention is the female variant as shown in more detail in FIG. 3, since in that case, with the coupling element removed, no parts of the valve 3 are readily accessible from the outside of the container, so that unintended opening of the dispensing valve is prevented in a simple manner. As shown in FIG. 4, however, a different type, such as the male variant, may also be used.

In the inner space 4 of the container 1, at the lower side of the valve, a riser tube 5 is provided, through which beverage can flow to the valve 3. Further included in the inner space 4 is a pressure control device 6, comprising a container 7 in which a gas under pressure is included, in particular $CO_2$, possibly together with active carbon or a like $CO_2$-gas absorbing and/or adsorbing material. An alternative is for instance zeolite. Arranged on the container 7 is an automatically operating pressure controller 8 which can control a valve, in particular an aerosol valve connecting to the container 7, to open if the pressure in the inner space 4 of the container 1 falls below a desired control pressure. Examples of such pressure controllers 8 are described in the publications mentioned in the introduction. A container 1 as shown in FIG. 1 is known in broad outline from Dutch patent NL1008601, incorporated herein for reference. Incidentally, also a different type of container may be used, for instance as known from U.S. Pat. No. 5,368,207 as far as the pressure controller and the different compartments are concerned.

In the present invention, in a container according to FIG. 1, the dispensing valve has been secured in the upper face of the container 1 using a folded connection, conventional in itself. To that end, the valve 3, surrounded by a folded collar 9, together with the riser tube 5 connected with the valve 3, has been inserted into an opening 40 in the container, preferably after it has been filled with the beverage such as beer, after which the folded collar 9 has been secured on the edge of the opening 40 with a conventional folded connection. Such a manner of securing is conventionally also referred to as a clinch connection. Incidentally, the valve can also be secured in a different manner, as long as a liquid- and gas-tight connection and closure are obtained.

The valve 3 is surrounded by first coupling means 10, which in the container as shown in FIG. 1 are designed as a profile part 41 of the folded collar 9. Preferably, a profile part is used which has an undercut 11.

A coupling element 12 is provided for operating the dispensing valve 3, which coupling element 12 moreover takes care of a fluid communication between the inner space 4 of the container 1 and a dispensing tube 13, in particular an at least partly relatively flexible dispensing tube, such as a hose 13, for dispensing the beverage. Shown in FIG. 3 are a series of alternative embodiments of such coupling elements 12 for use with a same female valve 3. The coupling element 12 comprises second coupling means 14 in the form of a clamping and/or snap edge or ring which can engage said first coupling means 10 and can cooperate therewith for retaining the coupling element 12 in a desired position. Of importance here is that the first and second coupling means 10, 14 are so designed that a fixed and preferably liquid-tight connection is obtained between the coupling element 12, in particular a stem 22 thereof, and the valve 3, in particular a passage thereof. Advantageously, the second coupling means 14 can be so designed that they can engage in or under the undercut 11 for retaining the coupling element 12.

A coupling element 12 as shown in FIG. 3 comprises a flange 16, for instance somewhat disc-shaped, having in a central part thereof a somewhat tubular passage 20 which extends in a direction away from an apron 18. The passage 20 extends through the flange 16 and is in open fluid communication with a hollow passage 21 of the stem 15 which extends from the flange 16, in the direction away from the passage 20, at least partly surrounded by said apron 18. The stem 15 is closed at the end 28 remote from the passage 20 and tapers slightly. On two opposite sides, the stem 22 is provided with openings 23, preferably slightly elongate, for instance rectangular or oval, through which the passage 21 is in open communication, or can be set in open communication, with the environment or, in coupled condition, with the inner space 4 of the container 1.

The valve 3 in the female variant is provided with a sleeve 24 which extends between the folded collar 9 and the riser tube and is substantially cylindrical. At an upper end of the sleeve 24, an opening 25 is provided to allow passage of the stem 15 with a proper fit. Arranged in the sleeve 24 is a valve body 26 biased in the direction of the opening by a spring 45, which valve body 26, on the side proximal to the opening, is provided with an edge 29 capable of sealing abutment against the ring 27 around the opening 25. Said ring 27 is preferably slightly elastic and thereby forms a valve seat. If the valve body 26 is pushed off the valve seat against the spring pressure, the dispensing valve is opened and a passage for beverage along the valve body is cleared. Using the stem 15 which can be inserted into the valve body 26, this opening movement of the dispensing valve can be achieved. The valve body 26 can be pushed off the valve seat so far that the openings 23 are brought at least partly and preferably wholly under the valve seat, for the desired magnitude of the flow-through between inner space 4 and the dispensing tube 13. The ring 27 abuts gas- and liquid-tightly against the outer side of the stem 15, at least above the openings 23 therein.

As the end 28 of the stem 15, in leading position in the direction of insertion, tapers slightly, a locating means is obtained, which considerably simplifies introducing the stem 15 into the valve 3, in particular into the opening 25 and the valve body 26 thereof. By providing at least a portion of the openings 23 in said slightly tapering end 28, moreover, at least that portion of the openings is brought, in frontal view, within the through-flow channel of the passage, so that the flow-through is further simplified. Sharp angles in the flow path for the beverage are thereby largely prevented.

Figure 3B:
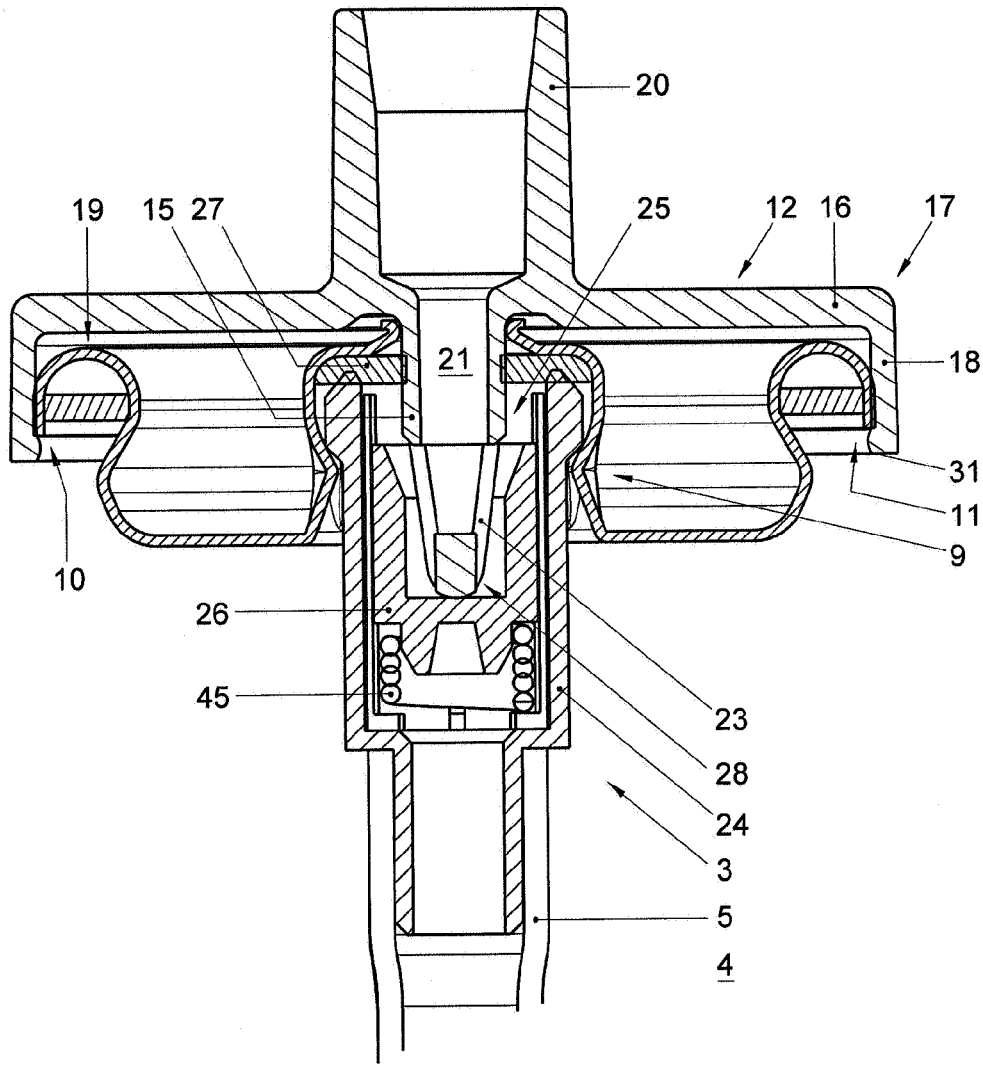
Figure 3C:
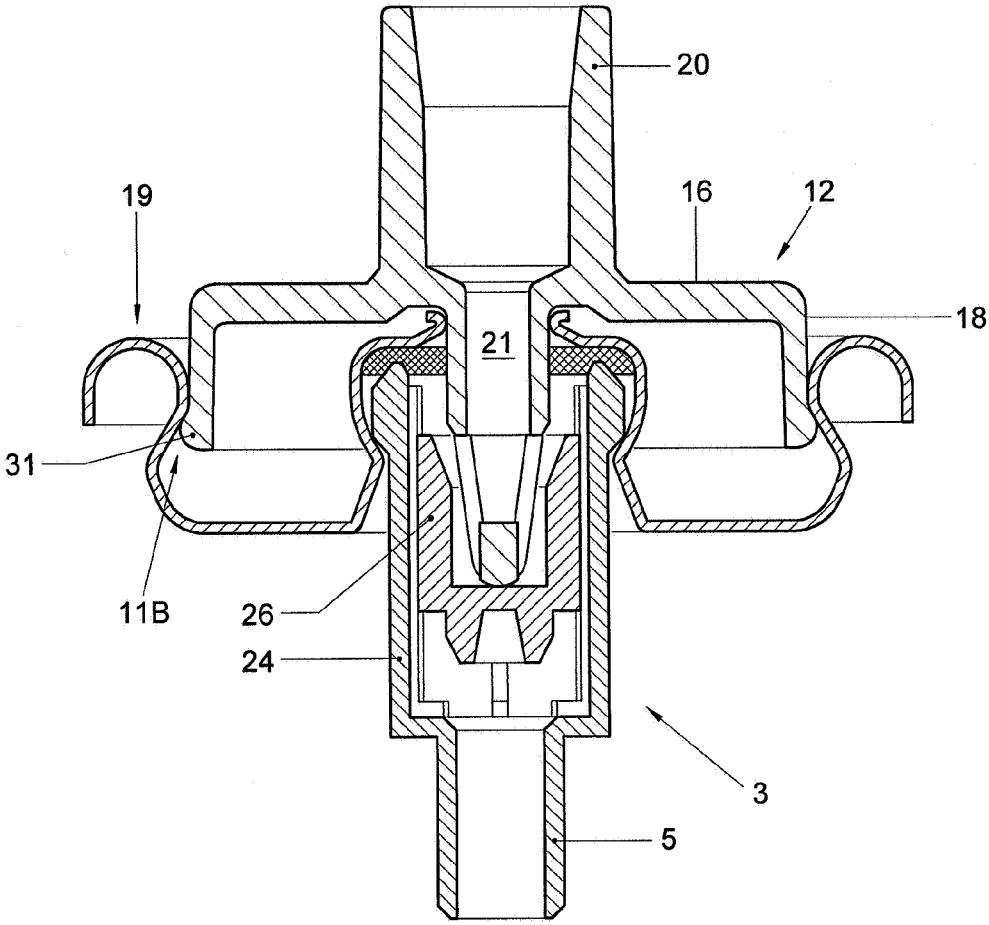
Figure 3D:
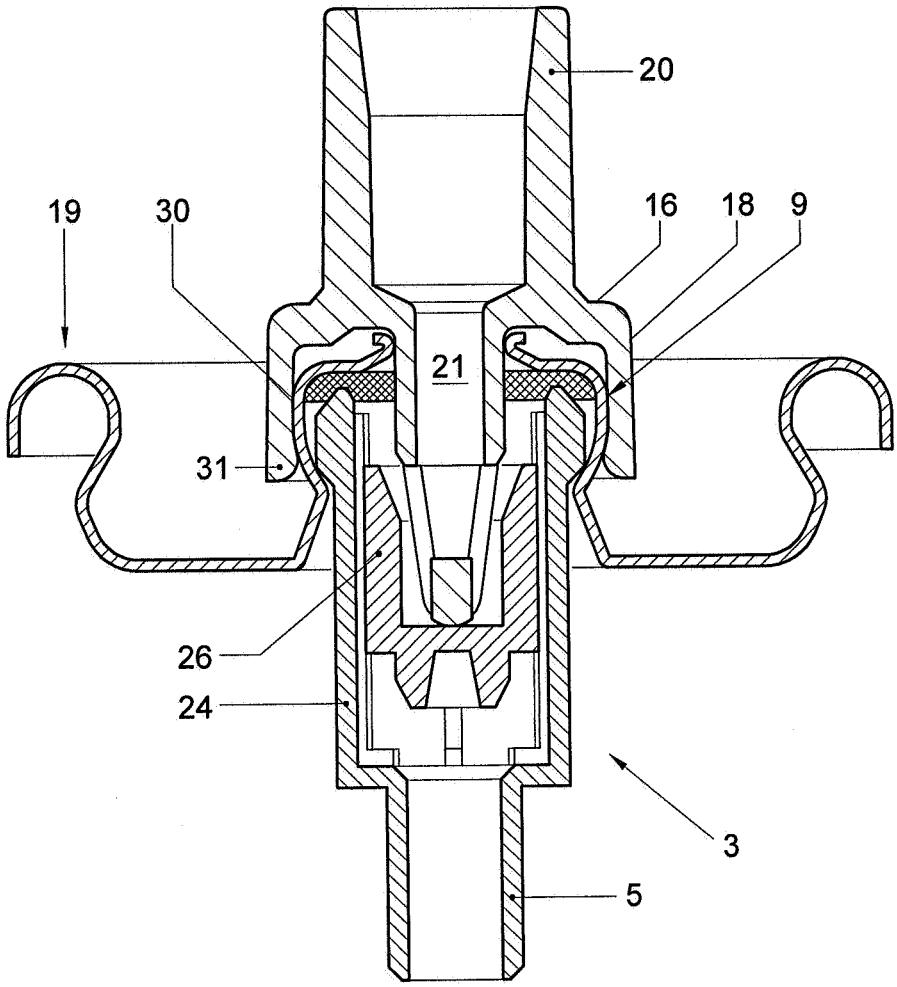
Figure 3E:
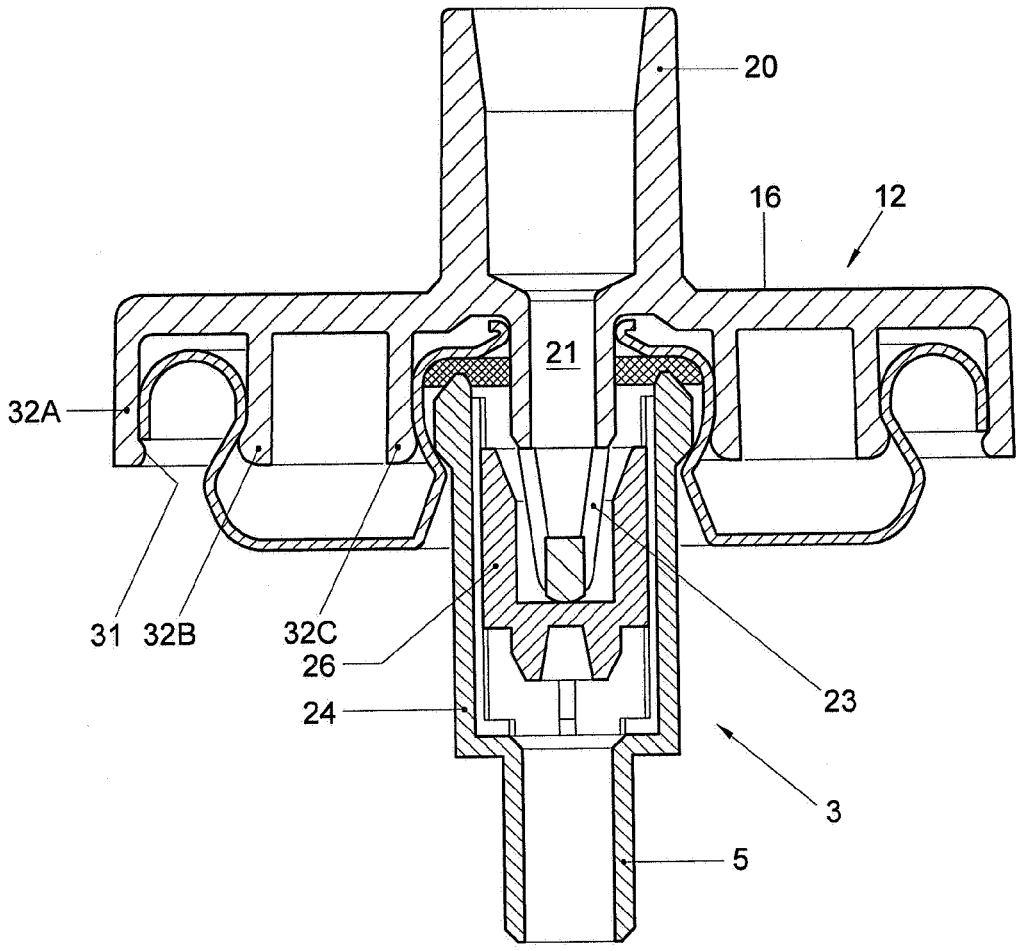

Along an outer edge 17 of the flange 16 of the coupling element 12, an apron 18 is provided which fits around or within an edge 19 of the folded collar 9. Said edge then forms at least a part of the first coupling means 10. The apron 18 in the embodiment shown in FIGS. 3 A and B is provided, on the inwardly facing side along at least a part of the circumference and preferably along the entire or substantially the entire circumference, with snap means 31 such as a snap edge or snap fingers as second coupling means 14, which can engage in an undercut 11A which has been formed along the outside, under said edge 19. In FIG. 3A, the coupling element 12 is shown detached from the coupling means 10, with closed valve. In FIG. 3B, the coupled position is represented with open valve 3. The snap edge 31 is retained in the undercut 11 by the material tension and/or form closure. In FIG. 3C, an embodiment is shown where the apron 18 clamps against the inside of the edge 19 of the clinch connection and/or is provided near the lower side with click edge (parts) 31 which engage in an undercut 11B. In FIG. 3D, the flange 16 and the apron 18 have a smaller diameter, while the apron 18 clamps from the outside against an elevation, commonly called dome 30, and/or engages in an undercut 11A. The dome 30 forms, at least elevation surrounds the sleeve 24 and ring 27 of the valve 3. In FIG. 3E, an embodiment is shown where a combination is used of the embodiments according to FIGS. 3A, C and D. To that end, three wall parts 32 A,B,C, extending approximately parallel to each other are provided on opposite sides of the stem 15 on an approximately straight flange 16. Thus a relatively small coupling element 12 has been obtained. Incidentally, it can also be designed with three concentric aprons 18A, 18B, 18C, with suitable snap means 31. Such a coupling element 12 is relatively strong and can afford an extra great clamping force.

Figure 3F:
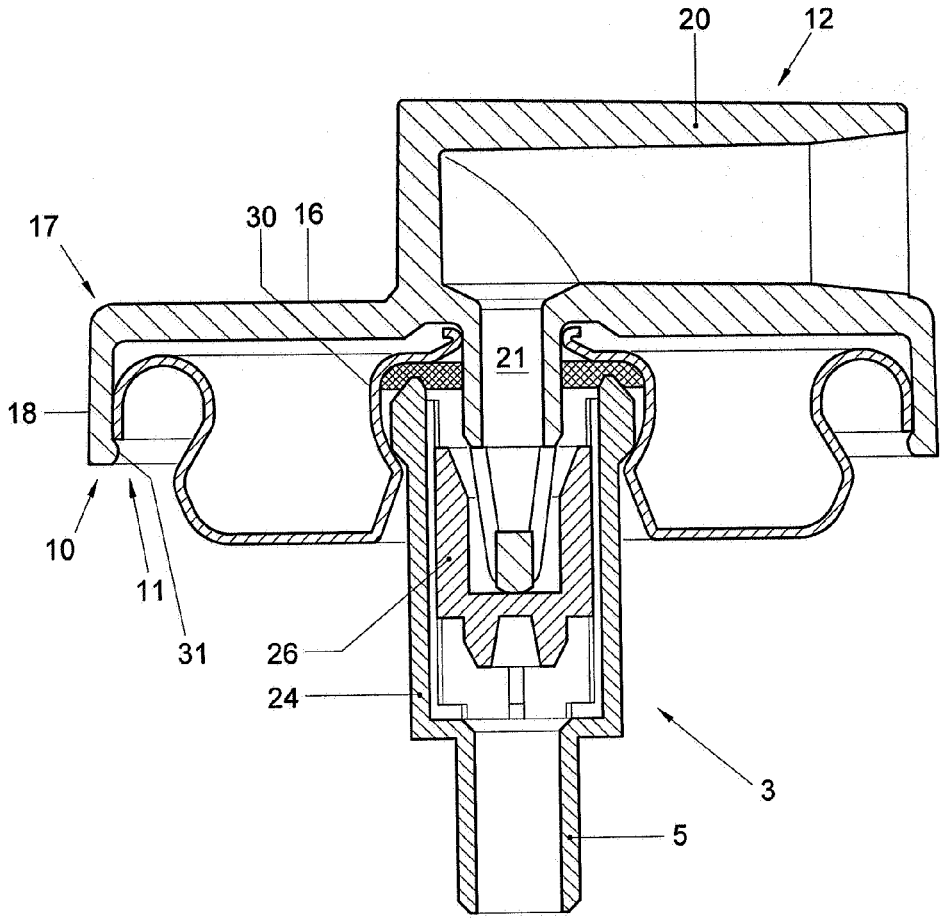

In FIG. 3F, an embodiment is shown of a coupling element 12 which is comparable to FIG. 3A, but where the passage 20 extends approximately parallel to the flange 16, approximately at right angles to a longitudinal direction of the stem 15. In this way, a relatively small height has been obtained.

Figure 3G:
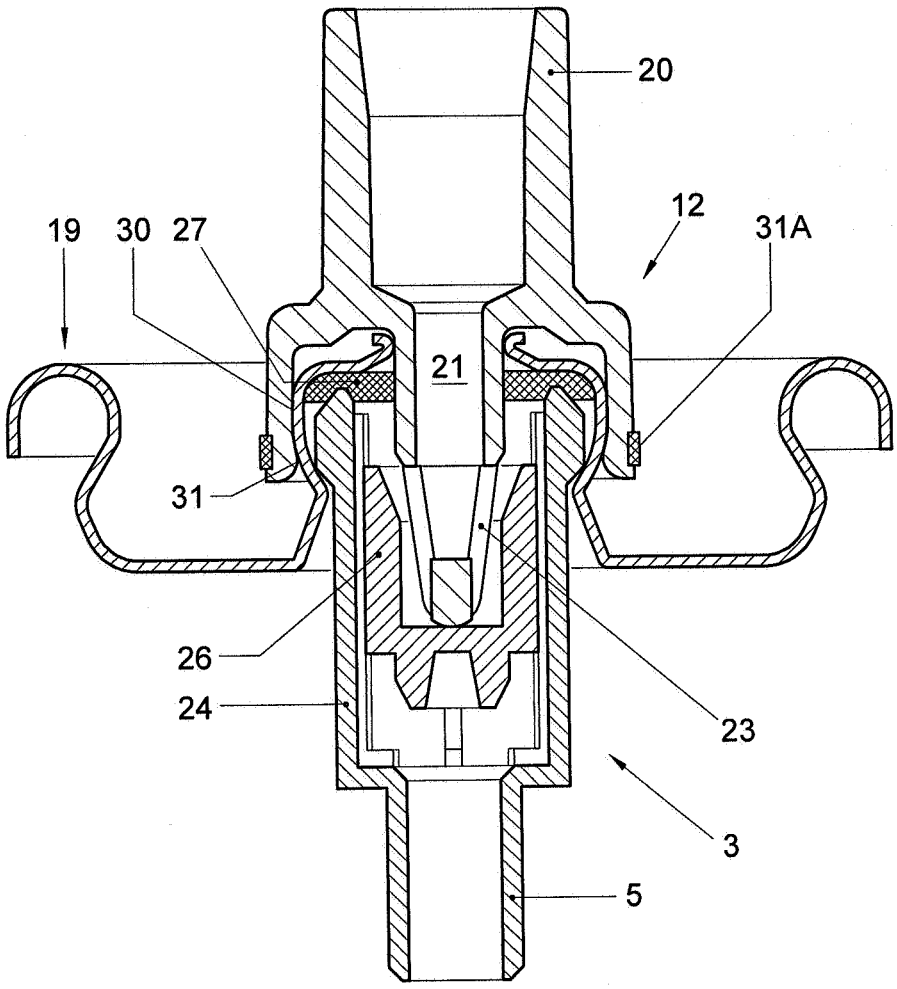

In FIG. 3G, an embodiment is shown which is comparable to that according to FIG. 3D but where, instead of or besides the snap means 31, a clamping element 31A, for instance a spring ring or the like, is used for securing the coupling element 12 on the dome 30.

Figure 3H:
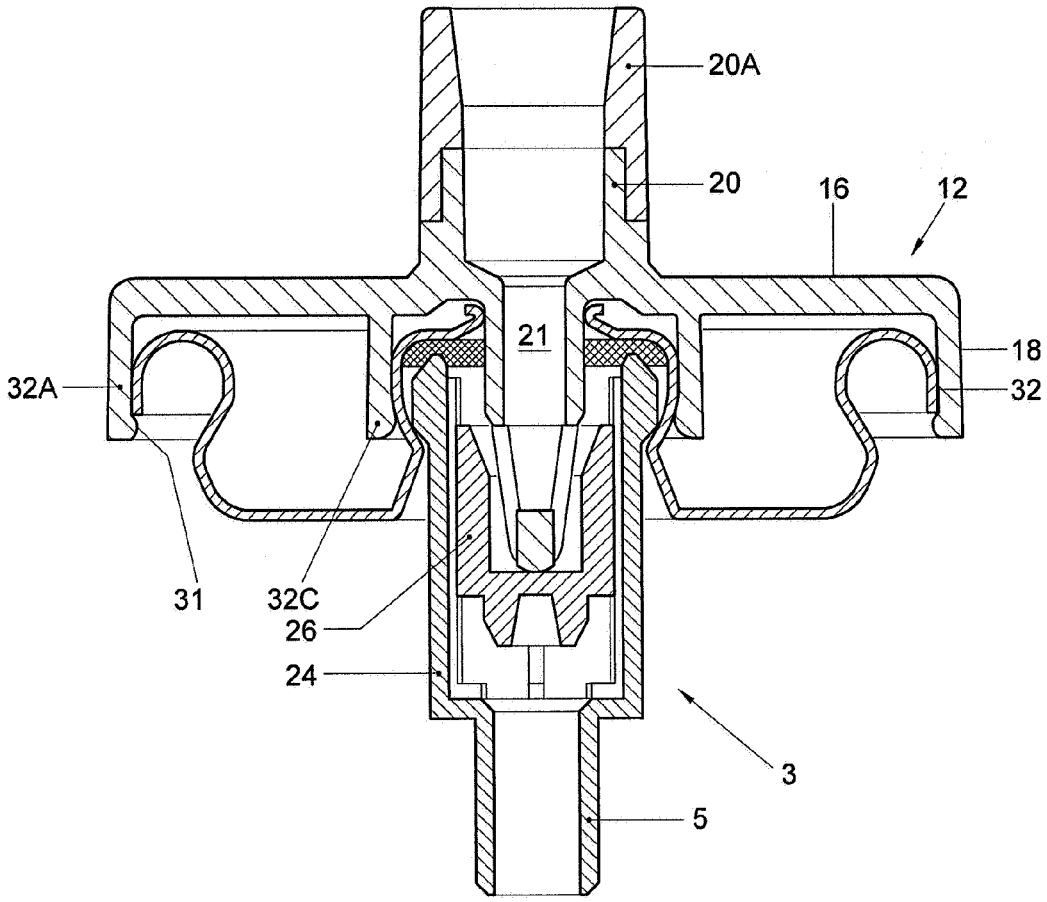

In FIG. 3H, finally, an embodiment is shown which is comparable to that according to FIG. 3E, but where only two parallel wall parts 32 A, C are provided on opposite sides of the stem 1. Here, for the upper part 20A of the passage, preferably a different material has been used than for the rest of the coupling element 12, in particular a slightly softer, weldable plastic, so that the hose 13 can be welded in the passage 20, while the rest of the coupling element is manufactured from a strong, form-retaining material. Incidentally, it holds for all embodiments shown that they can be manufactured from weldable plastic, while also other connections can be used, such as gluing, clamping, form-closures and the like.

Figure 2:
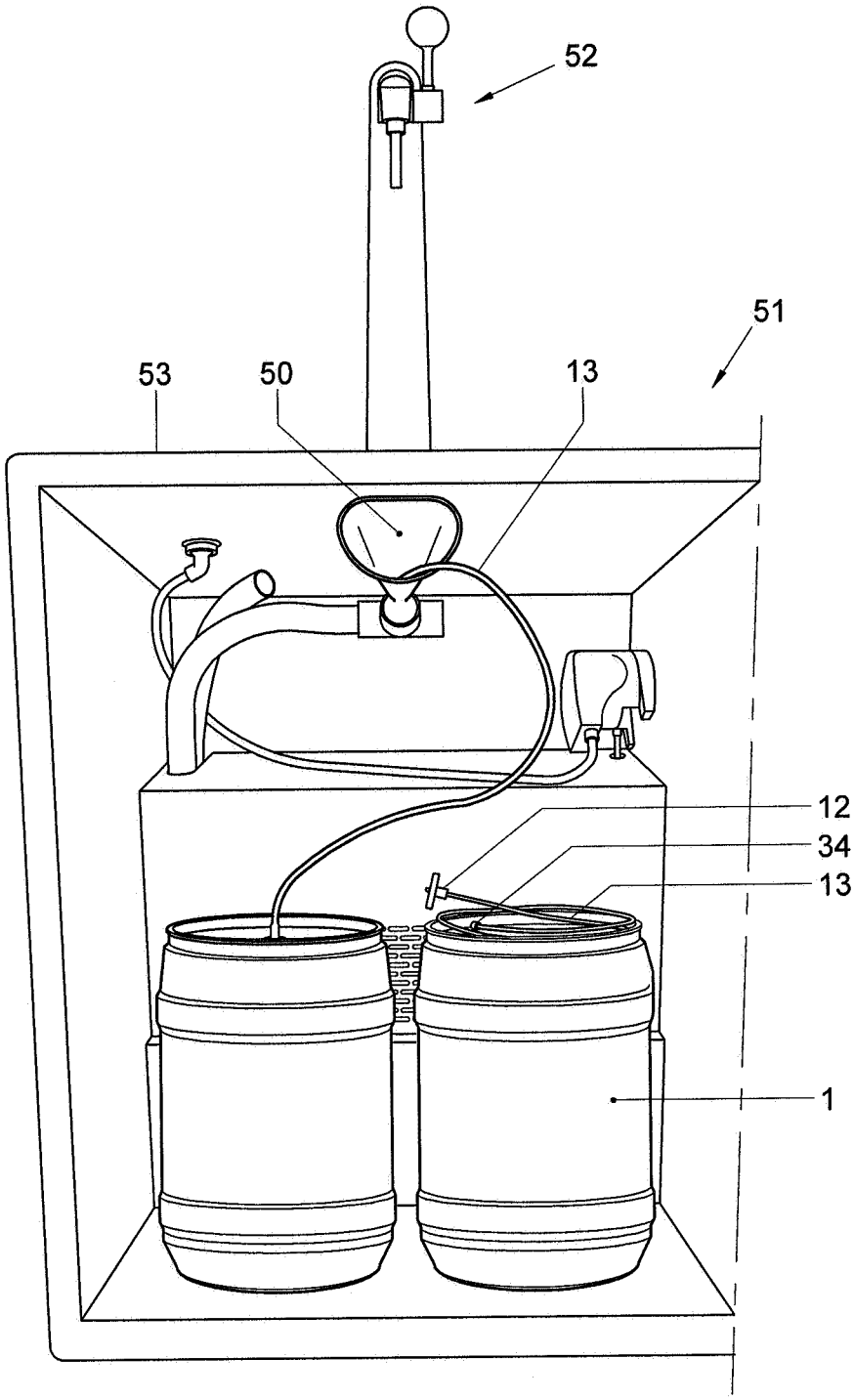
FIG. 2 shows a container according to the invention, in a tapping device.

In the embodiments shown in FIG. 3, the stem 15 has a length that is greater than the height of the or each apron 18 under the flange 16, so that the stem 15 can be centered well, by the locating means, in particular by the slightly tapered end 28, before the or each apron is secured with the second coupling means 14 onto the first coupling means 10. In this way, proper securing is simplified. In or on the passage 20, in the embodiments shown, a hose 13 or like slightly flexible dispensing tube is secured, as shown in FIG. 3 A and in FIG. 4. This may for instance be clamped in or over the passage 20, or preferably be welded or glued, so that a liquid-tight joint is obtained. Incidentally, it is also possible to (co)supply a loose hose 13 which can be adjusted to length by a user and can be secured in or on the coupling element 12 prior to use. The hose 13 preferably has a stiffness that is sufficient to pass a free end 33 leading in the flow direction through an inlet tube 50 of a tapping device 51 arranged for that purpose, such as described, for instance, in Dutch patent NL1015359, incorporated herein for the purpose of illustration. Near said leading end 33, as schematically shown in FIG. 2, a valve 34 may be included, such as for instance described in EP1284918, which application is incorporated herein for the purpose of illustration. This valve 34 is preferably fabricated such that it is closed until it is opened during use with the aid of a tapping cock 52 arranged for that purpose. In this way, early and/or undesired outflow of beverage is prevented.

In a container according to the invention, preferably, prior to use and after the container has been filled and the pressure control device has been included in the inner space, the shut-off valve is placed and covered by seal means, for instance a cap. Moreover, preferably, the coupling element is covered on the side of the stem 15, at least such that the stem and the openings 23 are covered as well as the valve 34. In this way, unintended or undesired use of the device can be prevented or at least be rendered visible, while moreover contamination is prevented. These seal means and/or protect means can be wholly or partly removed before use or be made of pierceable design.

In each of the embodiments shown, the coupling element 12 is used to open the dispensing valve 3 completely in one go and to keep it open. To that end, the first and second coupling means 10, 14 cooperate. In the use of a container 1 according to the invention, the hose 13 is preferably supplied as a loose item along with the coupling element 12 and preferably the valve 34 fixedly connected therewith. The container is cooled to a desired temperature, for instance between 0 and 8 degrees Centigrade, which temperature is naturally chosen depending on the beverage. To that end, a refrigerator 53 of the tapping device as shown in FIG. 2 can be used. After the container with the beverage is cooled, the coupling element 12 is pressed onto the valve 3, such that the stem 15 is pressed into the opening 25 and against the valve body 26. At the same time, the second coupling means 14 are then arranged over the first coupling means 10, so that these are brought into and held in a coupled condition. Preferably, the coupling element cannot be taken away again without damage, so that reuse is prevented. In the coupled position, the valve 3 is opened and as a result of the control pressure built up by the pressure control device 6, beverage, in particular beer, flows through the opened valve, along the valve body 26 into the hose 13 as far as the valve 34, if provided. Upon opening of the valve 34, the beverage will flow out of the hose 13, out of the end 33 without contact with the device 41. The pressure in the container is automatically kept at the required level by the pressure control device.

The container is preferably designed as disposable container, while container and hose with coupling element can be jointly discarded. The hose then preferably ensures during use that no contact exists between the beverage to be dispensed and the fixed parts of the tapping device, such as tapping column 42, cock 43, connecting means, refrigerator 40 and the like, so that the necessity of cleaning is limited to a minimum.

It has been found that in contrast to the known devices, where a minimal amount of $CO_2$ per liter was aimed for, and which conventionally utilized less than 40 milliliters (at room temperature) of $CO_2$ for each liter of beer, more $CO_2$ leads to a much better tapping behavior in tapping devices with an automatic pressure control as described. Surprisingly, it has been found that it is advantageous, in any case with blond beers, when the ratio of $CO_2$ to beverage (in particular beer) is less than 1:25, for instance between 1:18 and 1:10. Surprisingly, it has been found that with such a ratio the tapping behavior during tapping of the entire volume of beverage can be kept optimal, also in the case of relatively long lines, for instance of a length greater than approximately twice the height of the container.

FIG. 4 shows in partly sectional side elevation an alternative embodiment of a dispensing valve of a container according to the invention, with a coupling element 12. The dispensing valve 3 is of the male type here. This means that the dispensing valve has a stem 22 which can be pressed down for clearing a passage 21 through the stem 22, which passage terminates in the upper end of the stem 22. In the embodiment shown in FIG. 4, the coupling element 12 is substantially designed according to FIG. 3A, but the passage 20 extends around the stem 22 and is provided with a narrowing 35, such that a shoulder 36 of the narrowing 35 can abut on the stem 22 around the passage therein, so that the stem 22 can thereby be pressed down. The hose 13 is secured in the passage 20. For the rest, reference is made to the description and reference numerals of FIG. 3A.

In FIG. 5, a container according to the invention is shown, in top plan view. Shown on the container 1 is a collar 37, in which for instance grips may be provided, for instance in the form of recesses 38. The collar 37 has an undercut 39 in which the hose 13 can at least partly be received, so that it can be simply supplied along with the container. In the collar, moreover, a recess 40 is provided in which the coupling element 12 can be inserted, so that a good protection and lock are obtained. Incidentally, the container may also be designed without collar or with a different collar and the hose 13 may be pre-mounted or be supplied differently, for instance as a loose item in a package and/or via a separate channel such as Internet.

In all the embodiments shown, the dispensing line is designed as a flexible dispensing hose. It will be clear, however, that this dispensing line can also be made partly or substantially completely stiff.

In the embodiments shown, a valve 3 has been shown which can be repeatedly opened and closed. However, it is also possible to use a closure to be opened a single time. The container can be used in any position, both upstanding as shown, but also horizontally or with the valve 3 facing down, in which case the riser tube can be omitted or needs to be designed differently so as to have an inlet near a lowest point of the inner space 4.

The invention is not limited in any way to the embodiments shown in the description and drawings. Many variations thereon are possible within the framework of the invention.

For instance, use can be made of a bag-in-container type container, where the pressure control unit may be accommodated in the bag or between the bag and the container. The dispensing valve may be designed differently and be arranged at a different position. The coupling element may be so designed as to connect fluid- and gas-tightly to the container, thereby forming a dispensing chamber in the coupling element. The coupling element may be designed in a different manner and for instance be built together from different parts or be built up in multiple injecting molding passes and/or from multiple materials. The container can have a stand ring on which it can be set up and may be manufactured from any suitable material. The pressure control unit can form a fixed part of the container and can for instance be provided in a compartment of the container.

These and comparable variations are understood to fall within the framework of the invention as outlined by the claims.

The invention claimed is:

1. A container, provided with an inner space and a dispensing valve, wherein in the inner space a gas-containing beverage is included, wherein a pressure control unit is arranged for automatically controlling pressure in the inner space, wherein around the dispensing valve first coupling means extend, furthermore comprising an at least partly flexible dispensing line which at or near a first end is arranged for dispensing beverage and at an opposite second end is provided with a coupling element which is provided with second coupling means for cooperation with the first coupling means, wherein the dispensing valve is designed as a female valve, and the coupling element is provided with a largely hollow stem with an end and at least one opening, wherein the dispensing line links up with the stem opposite said end, the arrangement being such that in coupled condition of the first and second coupling means the stem extends against or into the valve and has brought the valve into and keeps it in an opened position, such that beverage can flow via the valve and said at least one opening into the dispensing line, wherein the pressure control unit, including a holder for pressure gas, is included in the container, wherein the coupling element cannot be removed from the container without damage to the container and/or the coupling element.

2. A container according to claim 1, wherein the stem has a longitudinal axis and the dispensing line has a longitudinal direction, wherein the dispensing line is connected with the coupling element, such that there the longitudinal axis of the stem extends approximately in line with the longitudinal direction of the line.

3. A container according to claim 2, wherein the dispensing line is connected with the stem.

4. A container according to claim 1, wherein the coupling element comprises a flange with a collar extending from near a longitudinal edge thereof, in which the collar is provided, remote from the longitudinal edge, with inwardly extending click means and/or outside extending click means for forming at least a part of the second coupling means, while the first coupling means comprise a complementary click edge around the valve.

5. A container according to claim 4, wherein in coupled condition the click means and the complementary click edge form a gas- and liquid-tight connection.

6. A container according to claim 1, wherein the coupling element is provided with a tube element or passage to which the dispensing line is secured.

7. A container according to claim 6, wherein a longitudinal direction of the dispensing line adjacent to the coupling element approximately coincides with a longitudinal axis of the tube element.

8. A container according to claim 1, wherein the stem, at least on an outer side, tapers slightly in a direction away from the dispensing line.

9. A container according to claim 1, wherein in the stem at least two openings are provided.

10. A container according to claim 9, wherein the at least two openings are opposite each other.

11. A container according to claim 1, wherein the at least one opening in the stem is slightly elongate with a longitudinal direction approximately parallel to the longitudinal direction of the stem.

12. A container according to claim 1, wherein the dispensing line is fixedly connected with the coupling element.

13. A container according to claim 1, wherein the coupling element is provided for forming a connection with the dispensing line.

14. A container according to claim 13, wherein forming the connection can be effected manually with the coupling element.

15. A container according to claim 1, wherein the dispensing line is provided, at or near the first end, with a valve for opening and closing the dispensing line.

16. A container according to claim 1, wherein the first and second coupling means are of self-locating design.

17. An at least partly flexible dispensing hose for use in a container according to claim 1.

18. A device for dispensing beverage, provided with a container according to claim 1, wherein the device is provided with a tapping cock in which the at least partly flexible dispensing line of the container can be laid.

19. A container according to claim 1, wherein the beverage is beer.

20. A container according to claim 1, wherein the valve is a female aerosol valve.

21. A container according to claim 1, wherein the container is closed to the environment except for the dispensing valve.

22. A container according to claim 1, wherein the valve comprises a valve body biased in a closed position.

23. A container according to claim 22, wherein the valve has a valve body and the end of the stem extends against or into the valve body.

24. A container according to claim 1, wherein the valve has a valve body and the end of the stem extends against or into the valve body.

25. A method for dispensing beverage from a container, wherein the container is set up and an at least partly flexible dispensing line is coupled therewith in that a coupling element of the dispensing line is secured around coupling means extending around a valve of the container, wherein the valve is brought into and held in an opened position by the coupling element or a part thereof, wherein beverage in the container is pressurized and so maintained using a gas supplied from a pressure control unit arranged in the container, and is guided via the valve and the coupling element into and through the dispensing line, wherein the pressure control unit, including a holder for pressure gas, is included in the container, with which pressure control unit pressure is regulated within the container both prior to and after coupling of the coupling element with the coupling means extending around the valve, wherein dispensing of the beverage is regulated by a valve or tapping cock at or near an end of the dispense line remote from the coupling element, wherein the coupling element is coupled to the coupling means extending around the valve permanently, such that after such coupling the valve is kept open permanently and the coupling element cannot be removed without damage to the coupling element and/or to the coupling means extending around the valve and/or to the valve.

26. A container, provided with an inner space and a dispensing valve, wherein in the inner space a gas-containing beverage is included, wherein a pressure control unit is arranged for automatically controlling pressure in the inner space, wherein around the dispensing valve first coupling means extend, furthermore comprising an at least partly flexible dispensing line which at or near a first end is arranged for dispensing beverage and at an opposite second end is provided with a coupling element which is provided with second coupling means for cooperation with the first coupling means, wherein the dispensing valve is designed as a female valve, and the coupling element is provided with a largely hollow stem with an end and at least one opening, wherein the dispensing line links up with the stem opposite said end, the arrangement being such that in coupled condition of the first and second coupling means the stem extends against or into the valve and has brought the valve into and keeps it in an opened position, such that beverage can flow via the valve and said at least one opening into the dispensing line, wherein the pressure control unit, including a holder for pressure gas, is included in the container, wherein the coupling element cannot be removed from the container without damage to the container and/or the coupling element and wherein the valve cannot be removed from the container without damage to the container and/or the valve.

* * * * *